US005533725A

United States Patent [19]

Reynolds, Jr.

[11] Patent Number: 5,533,725

[45] Date of Patent: Jul. 9, 1996

[54] GOLF PUTTER

[76] Inventor: Walker Reynolds, Jr., 14 Rendalia Rd., Anniston, Ala. 36201

[21] Appl. No.: 387,175

[22] Filed: Feb. 13, 1995

Related U.S. Application Data

[63] Continuation-in-part of Ser. No. 241,278, May 11, 1994, Pat. No. 5,388,827.

[51] Int. Cl.[6] ..... A63B 53/02; A63B 53/04

[52] U.S. Cl. ..... 473/307; 473/338; 473/339; 473/341

[58] Field of Search ..... 273/167 R, 168, 273/78, 169, 170, 171, 172, 173, 174, 175, 167 A, 167 B, 167 C, 167 D, 167 E, 167 F, 167 G, 167 H, 167 J, 167 K, 77 A, 80 R, 80 D, 80.1–80.9, 164.1

[56] References Cited

U.S. PATENT DOCUMENTS

| | | | |
|---|---|---|---|
| 1,455,379 | 5/1923 | Allen | 273/171 |
| 1,540,559 | 6/1925 | Murphy | 273/80.3 |
| 1,958,032 | 5/1934 | Cocke | 273/80.2 |
| 2,257,575 | 9/1941 | Reach | 273/171 |
| 3,430,957 | 3/1969 | Andis | 273/80.1 |
| 3,606,327 | 9/1971 | Gorman | 273/171 |
| 4,655,459 | 4/1987 | Antonious | 273/171 |
| 4,881,737 | 11/1989 | Mullins | 273/80.1 |
| 5,388,827 | 2/1995 | Reynolds | 273/80.1 |
| 5,390,918 | 2/1995 | Meyers | 273/80.1 |

*Primary Examiner*—Sebastiano Passaniti
*Attorney, Agent, or Firm*—Veal & Marsh

[57] ABSTRACT

A golf club, such as a putter, utilizes removable shafts and weights to vary the pressure of the putter relative to the putting surface speed. Alternative embodiments affix the shaft with a whistle stop notch or a conical wedge. Various strategies for detachably retaining weights in the club head are shown. The club striking face and club head appearance remain unaltered and thereby retain user familiarity and confidence.

21 Claims, 5 Drawing Sheets

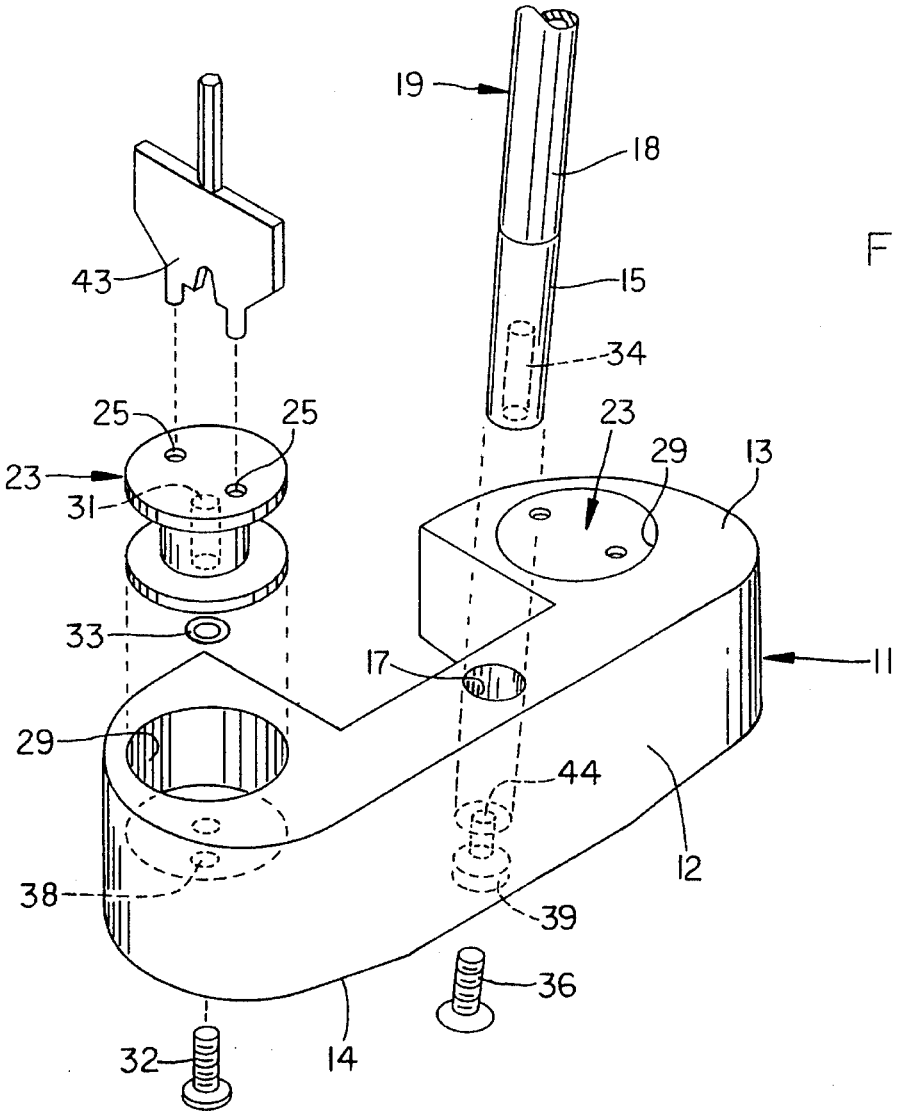
FIG. 2
FIG. 2A
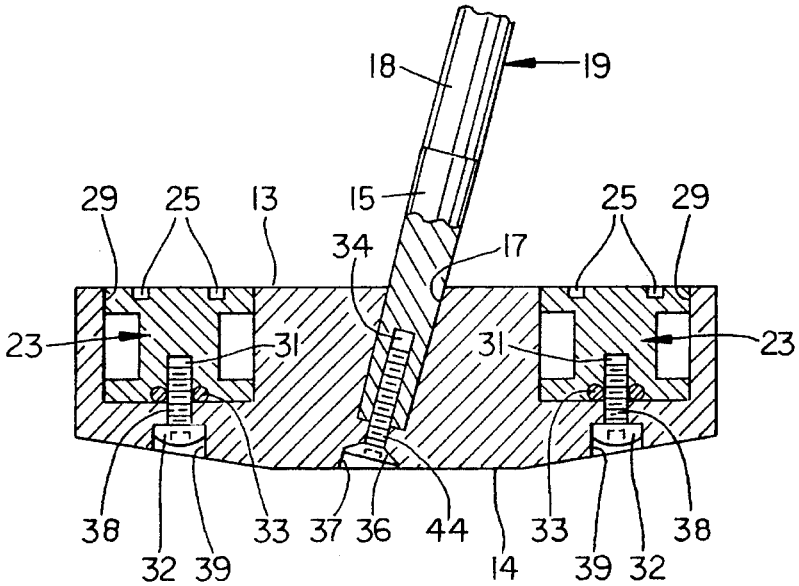

GOLF PUTTER

This application is a continuation-in-part of application Ser. No. 08/241,278, filed May 11, 1994, now U.S. Pat. No. 5,388,827.

FIELD OF THE INVENTION

The present invention relates generally to the game of golf and more particularly to the putters used in the play of the game. In greater particularity, the present invention relates to the construction of putters, wherein the head of the putter may be detachable from the shaft and the weight of the putter may be varied.

BACKGROUND

Golfing enthusiasts will appreciate that most golf clubs, including the putter, are manufactured in such a manner as to be unitized in construction. That is to say, the head and shaft are not readily separated from one another. Thus one is relegated to a single putter and is constrained to try many putters to get one that is satisfactory. It must be appreciated that putting is the most critical part of the golfer's game and that the saying "you drive for show, but putt for dough!" emphasizes that you six foot putt counts just as much as the two-hundred and fifty yard drive, and that if the six foot putt is missed the subsequent six inch putt counts just as much as the other two. Also, the putter is the only club that the golfer expects to use on every hole. Thus, the confidence of the golfer in the putter is essential to enjoyment of the game and to being a competitive player.

The factor which is uncontrollable by the golfer is the speed of the greens on which he putts. The moisture content of the grass, the type of grass, the length of the grass, the proximity of water to the green, and the composition of the soil in the green, all affect the speed of the greens. Thus, playing on the same course on subsequent days often presents the golfer with greens that are remarkably different in speed on the same hole. Accordingly, a golfer who is intent on reducing his score will try to adjust his putter or his swing to accommodate the speed of the greens. In making an adjustment to the putter, the golfer may feel more secure using a shorter handled putter on faster greens or a lighter weighted putter on faster greens, yet subconsciously changing putters reduces the golfer's sense of well-being. In other words, most golfers feel that they can hit their shots with their clubs better than they can with unfamiliar clubs including the putter, thus changing putter from day to day reduces the golfer's confidence. Likewise, if the golfer knows that the greens vary, he is somewhat concerned about using a putter that he cannot fine tune to the greens. It is known that there exist putters which can be adjusted in weight, including the inventor's own putter which is covered in U.S. Design Pat. No. D-282,480. However, merely adjusting the weight is not always sufficient to put the golfer's mind at ease. In as much as golf is a mental game, the improvements described hereinafter allow the golfer to fine tune his putter from day to day to satisfy himself that the putter is "right" and that he can use the club properly.

SUMMARY OF THE INVENTION

It is the object of the invention to provide a putter which will improve the game of a golfer who uses it regularly.

It is an object of this invention to provide a golfer with a putter which retains its familiarity even though its functional characteristics are varied.

It is a further object of the invention to provide a putter which can be fine tuned by the golfer to suit his playing preference in accordance with the speed of the greens on which he is playing.

These and other objects and features of the invention are accomplished in the provision of a putter wherein the putter head remains the same in appearance in as much as the same head is always used by the golfer. He is able to vary the length of the shaft to which the putter head is attached and to vary the weight of the putter. In the further disclosure of this application are two embodiments of the manner in which the shaft may be detachably affixed to the putter head. Each share a common feature in that the end of the shaft has a ferrule extension which allows insertion and detachment into the putter head. In one embodiment the ferrule extension is captured by a set screw engaged into a stop notch near the end of the ferrule extension, and in another the extension contains an internally threaded bore which receives a threaded bolt such that the shaft, ferrule extension, and head are drawn into firm engagement by rotation of the securing bolt.

BRIEF DESCRIPTION OF THE DRAWINGS

Apparatus embodying my invention are depicted in the appended drawings which form a part of this disclosure and wherein:

FIG. 2 is an exploded view of the putter components of the first head attachment embodiment and showing a removable weight and tightening tool.

FIG. 2A is a sectional view of the first head attachment embodiment and also shows an embodiment of a weight attachment.

DESCRIPTION OF THE PREFERRED EMBODIMENTS

Figure 1:
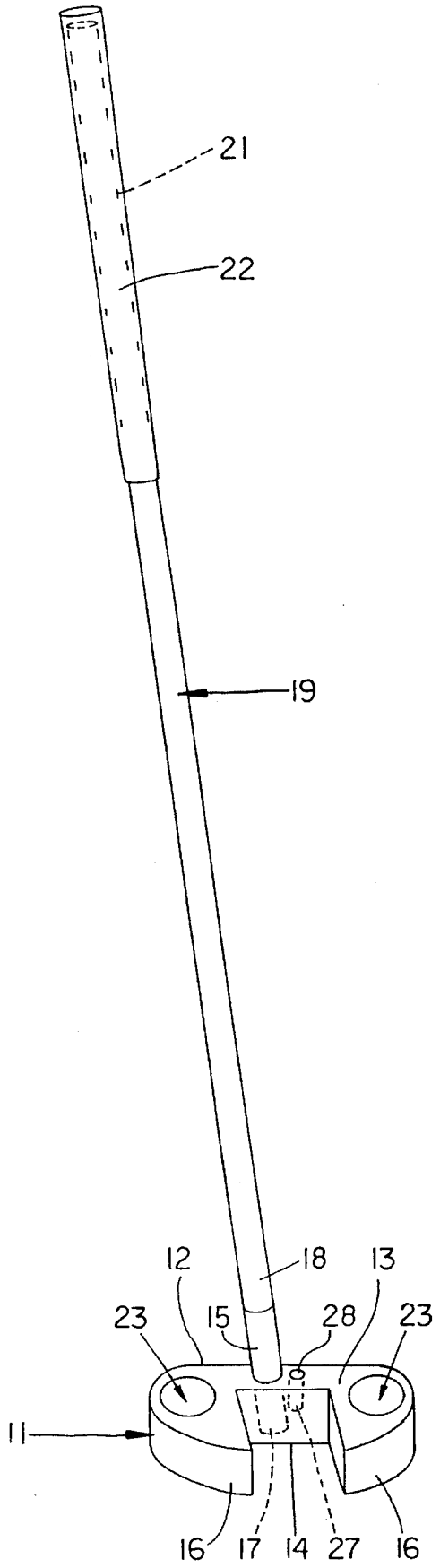
FIG. 1 is a perspective view of my putter.

Referring to the drawings for a clearer understanding of the invention it may be seen that I have chosen to illustrate the putter with a head in the form which I had previously patented in U.S. Design Pat. No. D-282,480. It should be understood that the teaching of the instant disclosure are not limited to putter heads which share the same ornamental appearance as this putter head, but rather are applicable to a variety of putter head shapes. The putter head is designated generally at 11 and includes a striking face 12, an upper surface 13, a lower surface 14, and a rear portion 16. The striking face is not impacted by my invention and little reference will be made thereto hereafter.

The upper surface 13 of the putter head has a central bore 17 formed therein which extends downwardly at an angle offset from normal to the upper surface 13 but parallel to the striking face 12. The bore 17 is appropriately sized to receive a ferrule extension 15 of a shaft 19 in a snug-fitting manner which allows insertion and withdrawal of the shaft 19 and extension 15 without deforming or galling of the adjacent surfaces. The snug-fitting placement of the ferrule extension 15 within the bore 17 prevents angular movement of the shaft 19 relative to the putter head 11. The opposite end 21 of the shaft carries thereon a grip 22 and will be referred to hereinafter as the handle 21 with end 18 being referred to as distal end 18.

Figure 3:
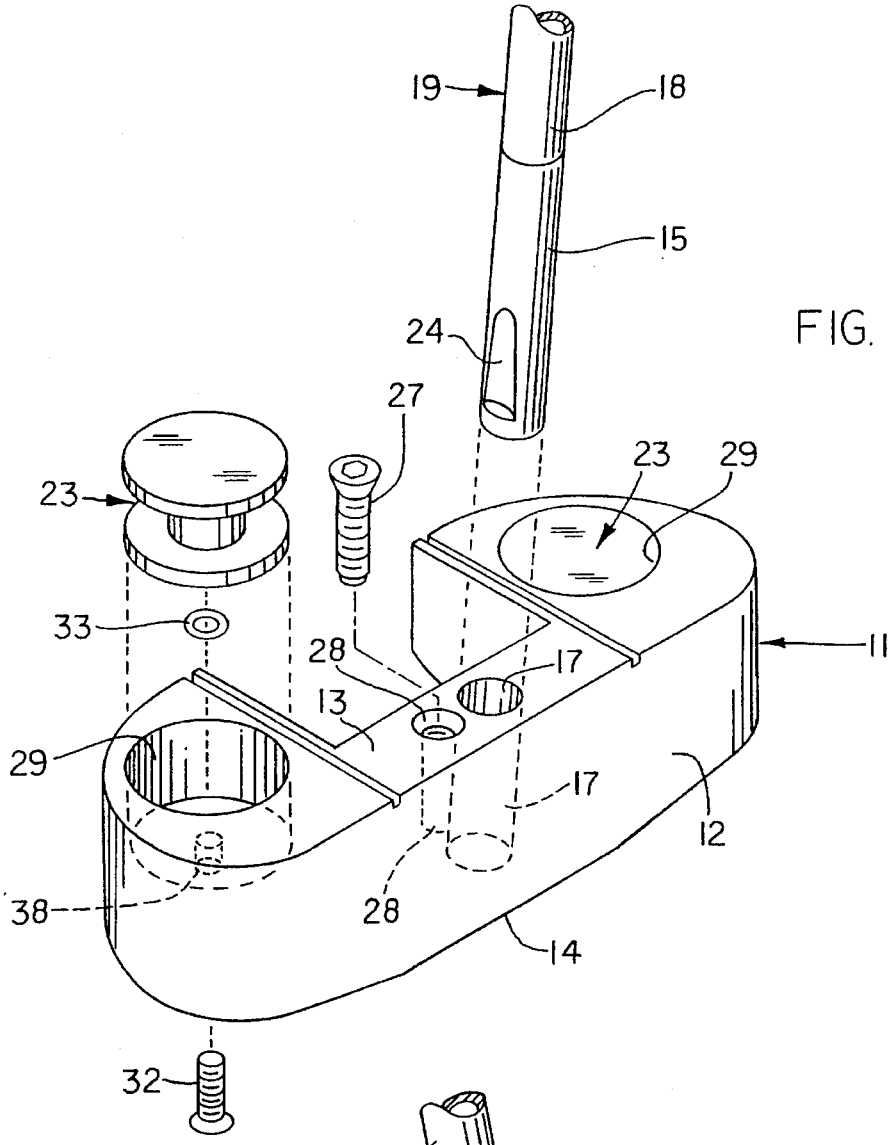
FIG. 3 is an exploded view of the putter components of the second head attachment embodiment.
Figure 3A:
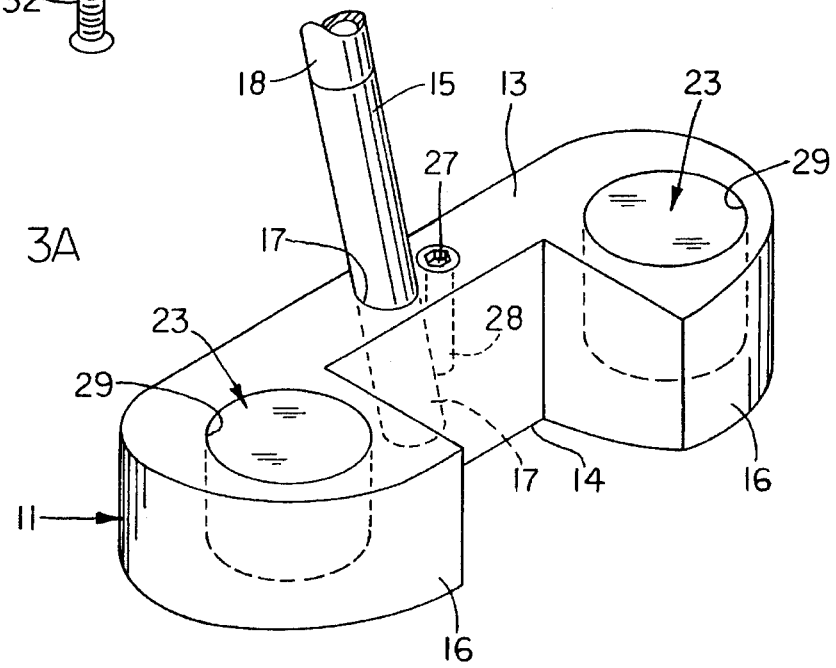
FIG. 3A is a perspective view of the reverse side of the second head attachment embodiment.
Figure 5:
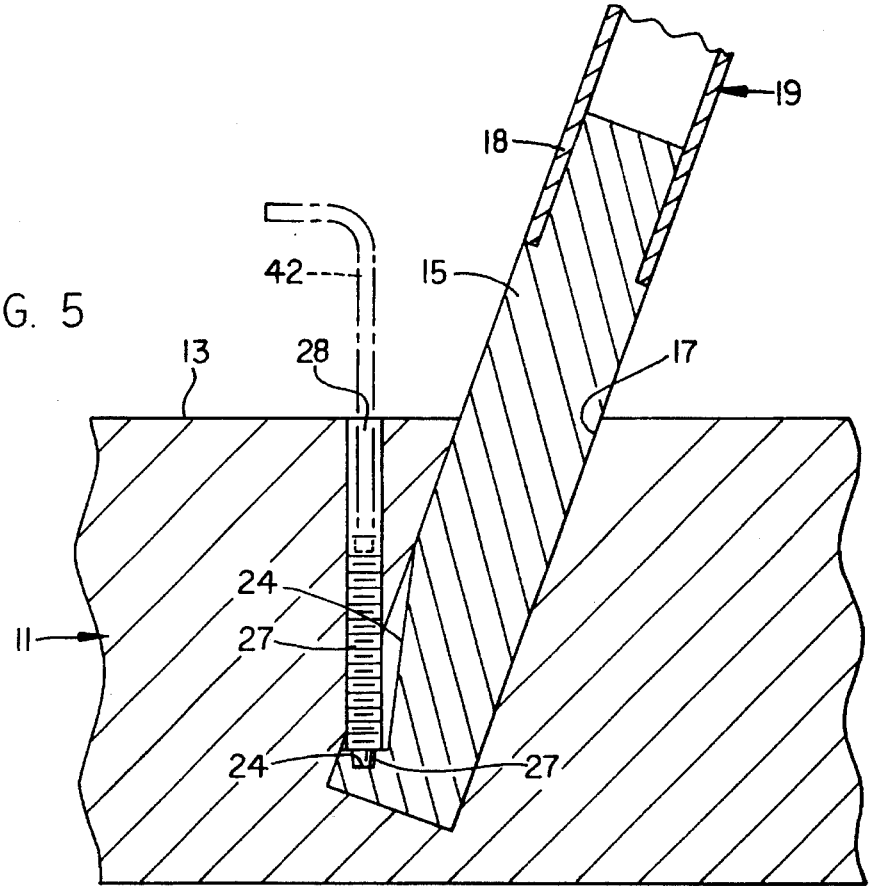
FIG. 5 is a magnified sectional view of the second head attachment embodiment.

As may be seen more clearly in FIG. 5 and FIG. 3, distal end 18 of the hollow shaft is pressed onto a ferrule extension member 15. Central bore 17 receives the ferrule extension 15 such that the flat end of the extension rests upon the flat bottom of the central bore. A secondary bore 28 having an internal thread formed therein is formed extending from the upper head surface 13 downwardly to intersect the central bore 17 proximal the lower end thereof. A set screw 27 is threadably received therein and is readily adjusted with an Allen wrench 42 or the like. A whistle stop notch 24 is formed on the exterior of ferrule extension 15 proximal the lower end thereof and is of sufficient width and depth to receive an end of the set screw 27. Set screw 27 may have a half dog $27^1$ received in an aperture $24^1$ as seen in FIG. 5. The notch 24 is positioned to properly align the handle 21 with the putter head 11 and allows the lower end of the set screw 27 to bear against the notch 24 thereby locking the ferrule extension member and, thereby, the distal end of the shaft 18 into the head 11. It will also be understood that the set screw can be loosened to allow the shaft to be removed and replaced by a shaft of a different length, thus varying weight and pendulum forces of the putter. That is to say that it is known that a shorter putter requires the golfer to assume more of a crouch to putt properly which in turn can be a conditioned stimulus to use the putter more delicately, as one might on faster greens.

Referring to FIG. 2 and FIG. 2A, one may note a second embodiment of the attachment mechanism wherein a recess 37 is formed in lower surface 14 and an aperture 44 provides communication between the recess 37 and central bore 17. In this embodiment the a restraining bolt 36 is inserted through the aperture 44 into a bore 34 in the center of the ferrule extension 15. The bolt 36 is rotated to threadably engage the ferrule extension 15 and tighten the extension into the central bore 17, thereby fixing the shaft 19 into the golf head 11. Both the bore 17 and extension 15 are slightly tapered. However, the bore tapers at a more rapid rate relative to the extension. Due to the taper differential, the extension 15 operates as a wedge and is pressed and rigidly fixed into the bore upon tightening of the bolt 36. This allows rotational adjustment of the head face 12 relative to the handle 21 position by loosening the restraining bolt, adjusting the shaft position relative to the golf head face 12, and re-tightening the restraining bolt 36 (see FIG. 1).

As shown generally in FIG. 1, it will also be appreciated that the weight of the putter head may be increased or decreased by varying the weight of a set of inserts 23 secured within the head 11. In this manner, the club may attain a "counter balance" of mass which assists in truer strikes. That is to say, proper weight, weight distribution and shaft length can be attained in one club using my invention. Furthermore, the principle of weight distribution can be applied to all clubs from driver to putter using my invention.

Various strategies may be used to releasably secure the removable weights within the putter head. FIGS. 2 and 2A show a first embodiment of weight attachment. A spool shaped weight 23 having flat top and flat bottom portions is appropriately sized to fit snugly but smoothly within the weight recess 29 within the golf head 11. A recess 39 is formed in lower head surface 14 and an aperture 38 provides communication between the recess 39 and a threaded bore 31 in the weight center. A retaining bolt 32 engages the bore 31 through the aperture 38 drawing the weight into a rigid secure position. An "O" ring 33 may also be placed to surround the bolt between the weight bottom and the weight recess bottom, thereby preventing random bolt loosening. Additional torque may be applied with a weight tightening tool 43 adapted to fit notches 25 in the flat top portion of the weight. The tool 43 may also provide an Allen wrench that can more easily tighten or loosen the retaining bolt 32 allowing easy exchange of various size weights.

Alternatively, the retaining bolt 32 may engage a threaded aperture 38. The retaining bolt may be fully screwed into an empty weight recess and glued in full engagement position. Several glues of suitable strength are readily available that will serve this purpose. Once the securing bolt 32 is fixed in place, the tightening tool may then be used to both screw the weight onto the securing bolt and tighten it.

Figure 3B:
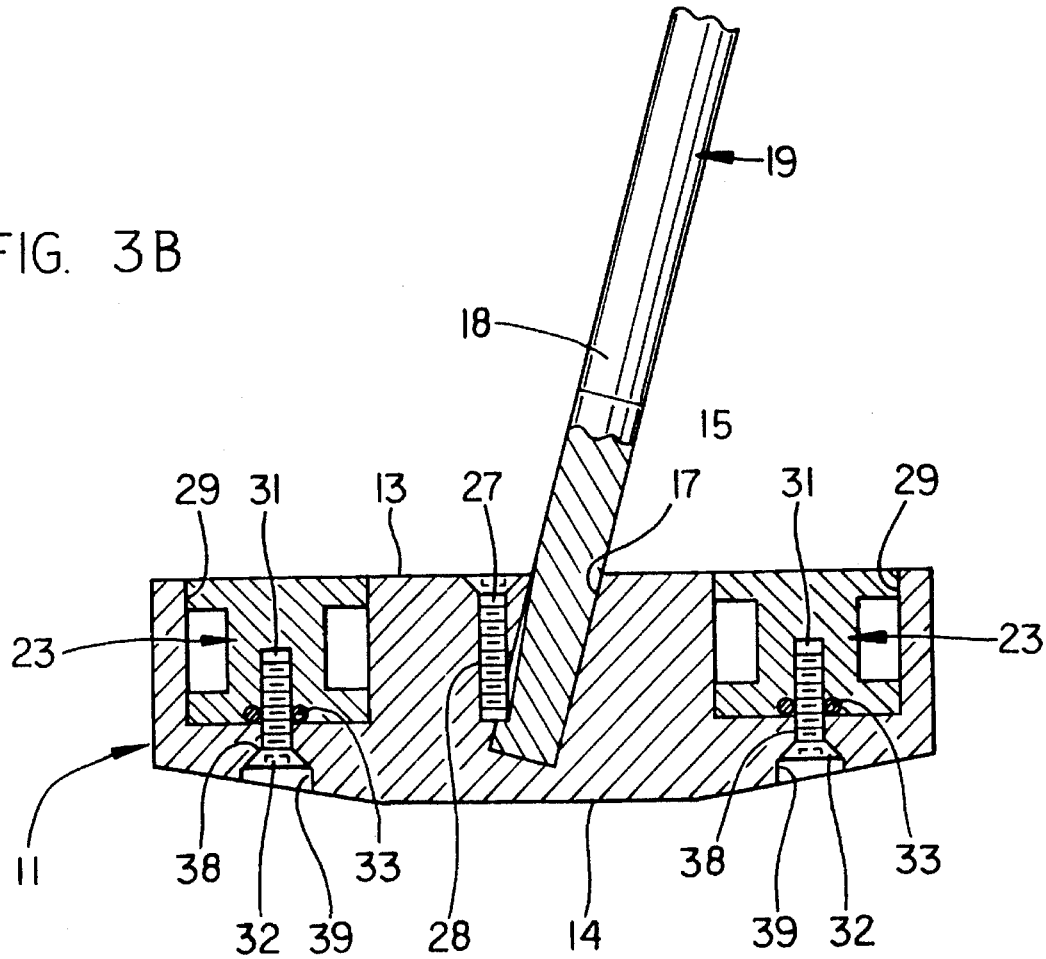
FIG. 3B is a sectional view of the second head attachment embodiment and also shows a second embodiment of weight attachment.
Figure 4:
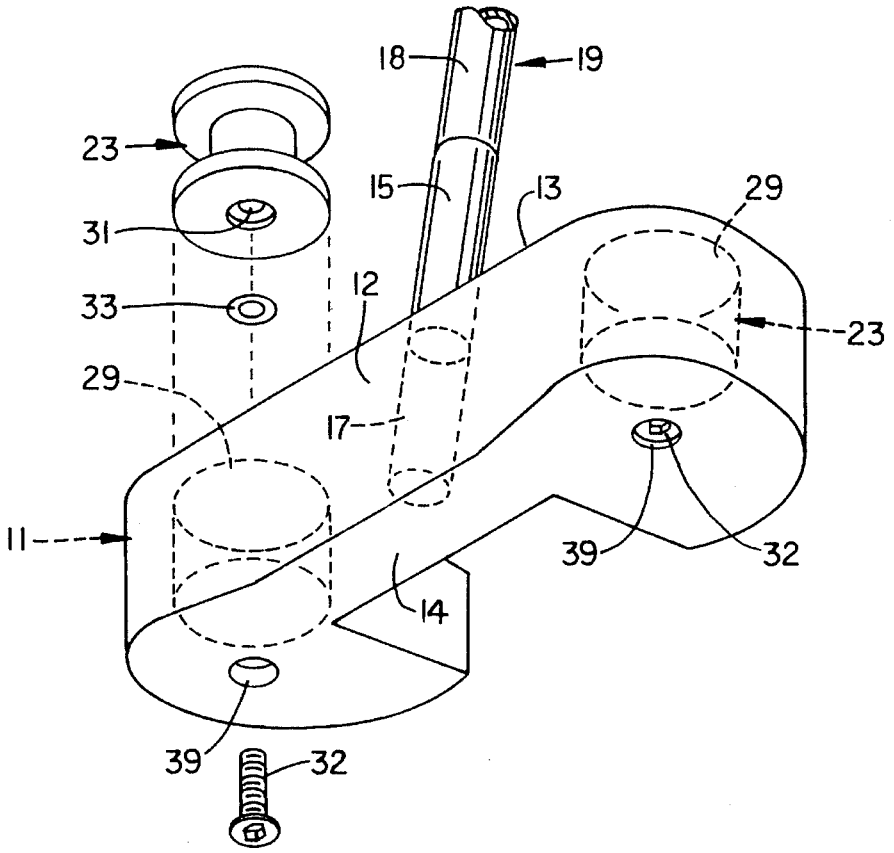
FIG. 4 is an exploded bottom perspective view of the components of the first head attachment embodiment and showing a second embodiment of weight attachment.

FIGS. 3, 3B, and 4 show a smooth-topped weight 23 secured by a bolt 32 as in the embodiment of FIGS. 2/2A. The retaining bolt 32 moves freely through a non-threaded aperture 38 to secure the weight 23 against the weight recess bottom. A suitable tool adapted to fit the bolt head, such as an Allen wrench, is used to torque the bolt in place. An "O" ring 33 may be used to prevent random loosening.

Figure 3C:
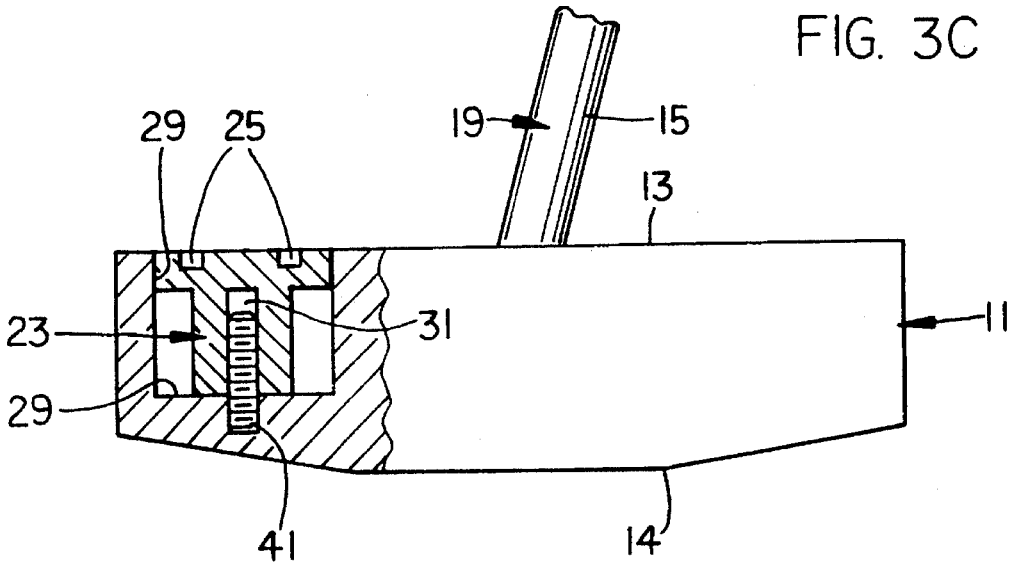
FIG. 3C is a sectional view of a third embodiment of weight attachment.

A final weight attachment method is illustrated in FIG. 3C. A threaded retaining stud 41 is permanently and rigidly affixed to the weight recess bottom. The weight 23 is then threaded onto the retaining stud 41 until fully engaged. A suitable torquing tool as shown in FIG. 2 engages notches 26 in the top of the weight 23 and then torques the weight tight onto the retaining stud 41.

FIG. 3C also illustrates a weight with reduced diameter bottom. As is evident, by varying the diameter and thickness of the top and bottom of the weights, the strength of the weights is also varied. Weights can, therefore, be cooperatively exchanged to vary club head weight.

While I have shown my invention in several forms, it will be obvious to those skilled in the art that it is not so limited but is susceptible of various changes and modifications without departing from the spirit thereof.

Having set forth the nature of the present invention, what is claimed is:

1. A golf putter comprising in combination:

a) a shaft having a handle and a distal end, said distal end being tubular;

b) a ferrule member rigidly attached to said distal end, extending longitudinally beyond said distal end;

c) a head having a striking face and an upper surface perpendicular to said striking face, said upper surface having a bore formed therein, oblique to the surface thereof and parallel to said striking face, of a dimension adapted to fixedly receive, said ferrule member such that said bore prevents angular movement of said shaft relative to said head; and d) means for engaging said ferrule member within said bore for releasably securing the same to said head.

2. A golf putter as defined in claim 1 wherein said shaft is replaceable with an alternative shaft of a different length to provide a putter of a different length.

3. A golf putter as defined in claim 2 wherein said head includes removable weights which can be selectively exchanged with cooperatively formed weights to adjust the overall weight of the putter.

4. A golf putter as defined in claim 1 wherein said means for engaging comprises:

a) a retaining screw threadably received in a threaded bore in said upper surface, said threaded bore intersecting said obliquely formed bore; and b) wherein said ferrule member further includes a whistle stop notch adapted to receive said retaining screw therein.

5. A golf putter as defined in claim 4 wherein said shaft is replaceable with an alternative shaft of a different length to provide a putter of a different length.

6. A golf putter as defined in claim 5 wherein said head includes removable weights which can be selectively exchanged with cooperatively formed weights to adjust the overall weight of the putter.

7. A golf putter comprising in combination:

a) a shaft having a handle and a distal end, said distal end being tubular;

b) a ferrule member rigidly attached to said distal end, extending longitudinally beyond said distal end;

c) a head having a striking face and an upper surface perpendicular to said striking face, said upper surface having a bore formed therein, oblique to the surface thereof and parallel to said striking face, of a dimension adapted to receive said ferrule member;

d) a threaded member threadably received longitudinally within said ferrule member and having a terminal portion extending longitudinally beyond said ferrule member;

e) an aperture providing communication between said bore and a recess in a lower surface of said head, said recess being co-axially aligned with said aperture and said bore, said threaded member extending from within said recess through said aperture to engage said ferrule member; and f) wherein said bore and said ferrule member taper in diameter cooperatively, so that said ferrule member is rigidly pressed within said bore upon tightening of said threaded member locking said handle radially and longitudinally in place.

8. A golf putter as defined in claim 7 wherein said shaft is replaceable with an alternative shaft of a different length to provide a putter of a different length.

9. A golf putter as defined in claim 8 wherein said head includes removable weights which can be selectively exchanged with cooperatively formed weights to adjust the overall weight of the putter.

10. A golf putter comprising in combination:

a) a shaft having a handle and a distal end, said distal end being tubular;

b) a ferrule member rigidly attached to said distal end, extending longitudinally beyond said distal end;

c) a head having a striking face and an upper surface perpendicular to said striking face, said upper surface having a bore formed therein, oblique to the surface thereof and parallel to said striking face, of a dimension adapted to fixedly receive said ferrule member such that said bore prevents angular movement of said shaft relative to said head, said upper surface of said head further having recesses for receiving removable weights;

d) removable weights contained within said recesses which can be selectively exchanged with cooperatively formed weights to adjust the overall weight of said putter;

e) means for engaging said ferrule member within said bore for releasably securing the same to said head; and f) securing means for detachably retaining said weights in said recesses.

11. A golf putter as defined in claim 10 wherein said shaft is replaceable with an alternative shaft of a different length to provide a putter of a different length.

12. A golf putter comprising in combination:

a) a shaft having a handle and a distal end, said distal end being tubular;

b) a ferrule member rigidly attached to said distal end, extending longitudinally beyond said distal end;

c) a head having a striking face and an upper surface perpendicular to said striking face, said upper surface having a bore formed therein, oblique to the surface thereof and parallel to said striking face, of a dimension adapted to receive said ferrule member, said upper surface of said head further having recesses for receiving removable weights;

d) removable weights contained within said recesses which can be selectively exchanged with cooperatively formed weights to adjust the overall weight of said putter, said weights have a generally spool-shaped body, a flat top portion, and a flat bottom portion with a threaded center bore for receiving a retaining member therein;

e) means for engaging said ferrule member within said bore for releasably securing the same to said head; and f) securing means for detachably retaining said weights in said recesses.

13. A golf putter as defined in claim 12, said securing means comprising:

a) a threaded member threadably received within said center bore of said weight; and b) an aperture providing communication between said center bore and a recess in a lower surface of said head, said recess being co-axially aligned with said aperture and said center bore, said threaded member extending from within said recess through said aperture to secure said weight.

14. A golf putter as defined in claim 13 wherein said aperture is threaded to receive said threaded member, and wherein said threaded member is locked in place in said aperture with a securing substance.

15. A golf putter as defined in claim 12, said securing means comprising a threaded member affixed within said removable weight recess and cooperatively received within said center bore of said weight.

16. A golf putter as defined in claim 12 wherein said top portion has notches for receiving a wrench tightening device adapted to fit said notches.

17. A golf putter comprising in combination:

a) a shaft having a handle and a distal end;

b) a head having a striking face and an upper surface perpendicular to said striking face, said upper surface having a bore formed therein, oblique to the surface thereof and parallel to said striking face, of a dimension adapted to receive said distal end, said upper surface of said head further having recesses for receiving removable weights;

c) means for engaging said distal end within said bore for releasably securing the same to said head;

d) removable weights contained within said recesses which can be selectively exchanged with cooperatively formed weights to adjust the overall weight of the putter, wherein said weights have a generally spool-shaped body, a flat top portion, and a flat bottom portion with a threaded center bore for receiving a retaining member therein; and e) securing means for detachably retaining said weights in said recesses.

18. A golf putter as defined in claim 17, said securing means comprising:

a) a threaded member threadably received within said center bore of said weight; and b) an aperture providing communication between said center bore and a recess in a lower surface of said head, said recess being co-axially aligned with said aperture and said center bore, said threaded member extending from within said recess through said aperture to secure said weight.

19. A golf putter as defined in claim 18 wherein said aperture is threaded to receive said threaded member, and wherein said threaded member is locked in place in said aperture with a securing substance.

20. A golf putter as defined in claim 17, said securing means comprising a threaded member affixed within said removable weight recess and cooperatively received within said center bore of said weight.

21. A golf putter as defined in claim 17 wherein said top portion has notches for receiving a wrench tightening device adapted to fit said notches.

* * * * *